US010407225B2

(12) United States Patent
Schlusemann et al.

(10) Patent No.: US 10,407,225 B2
(45) Date of Patent: Sep. 10, 2019

(54) CLOSURE AND PACKAGE THAT VENTS AT HIGH PRESSURE

(71) Applicant: Closure Systems International Inc., Lake Forest, IL (US)

(72) Inventors: Tyler J. Schlusemann, Lafayette, IN (US); Navaneeth Bashyam, West Lafayette, IN (US)

(73) Assignee: Closure Systems International Inc., Memphis, TN (US)

( * ) Notice: Subject to any disclaimer, the term of this patent is extended or adjusted under 35 U.S.C. 154(b) by 0 days.

(21) Appl. No.: 15/805,987

(22) Filed: Nov. 7, 2017

(65) Prior Publication Data

US 2019/0135507 A1 May 9, 2019

(51) Int. Cl.
*B65D 51/16* (2006.01)
*B65D 41/34* (2006.01)

(52) U.S. Cl.
CPC ..... *B65D 51/1661* (2013.01); *B65D 41/3428* (2013.01)

(58) Field of Classification Search
CPC ..... B65D 51/1661; B65D 51/1633; B65D 51/16; B65D 41/3428; B65D 41/3423; B65D 41/34; B65D 41/365; B65D 41/36; B65D 41/48; B65D 41/3409; B65D 41/0421
USPC ..... 220/303, 304, 293, 288, 266, 265, 220/203.09, 203.01, 803, 804, 806, 802, 220/801, 796; 215/329, 344, 343, 341, 215/254, 253, 256, 250; 222/541.6, 222/541.1, 563
See application file for complete search history.

(56) References Cited

U.S. PATENT DOCUMENTS 1,861,442 A 6/1932 Hammerstein
3,568,871 A * 3/1971 Livingstone ..... B65D 41/0421 215/344
3,667,638 A 6/1972 Cambio
(Continued)

FOREIGN PATENT DOCUMENTS

CN 203094727 U 7/2013
DE 20210304 U1 10/2002
(Continued)

OTHER PUBLICATIONS

International Search Report and Written Opinion in International Patent Application No. PCT/US2018/059244, dated Mar. 4, 2019 (10 pages).

*Primary Examiner* — Robert J Hicks
(74) *Attorney, Agent, or Firm* — Nixon Peabody LLP

(57) ABSTRACT

A closure includes a top wall portion, an annular skirt portion, a continuous plug seal, a top sealing member and a top stop. The skirt portion, the plug seal and the top stop depend from the top wall portion. The top sealing member is located between the plug seal and the skirt portion. The top stop is located between the plug seal and the skirt portion. The sealing member extends to and contacts a top surface, a top portion of the inner radius/corner or the outer radius/corner of the finish of the container when the closure and the container are in mating engagement with each other at an atmospheric internal pressure. At higher internal pressures, the top sealing member and the top stop are spaced from and located above the top surface of the finish.

22 Claims, 5 Drawing Sheets

(56) References Cited

U.S. PATENT DOCUMENTS

| | | | | | |
|---|---|---|---|---|---|
| 3,672,527 | A * | 6/1972 | Bly | B65D 41/485 | 215/253 |
| 3,770,156 | A * | 11/1973 | Yates, Jr. | B65D 43/0256 | 215/250 |
| 3,834,596 | A | 9/1974 | Brady | | |
| 3,844,439 | A * | 10/1974 | Demers | B65D 41/0428 | 215/344 |
| 3,944,104 | A * | 3/1976 | Watson | B65D 41/0421 | 215/307 |
| 4,458,822 | A | 7/1984 | Ostrowsky | | |
| 4,470,513 | A | 9/1984 | Ostrowsky | | |
| 4,505,401 | A | 3/1985 | Berglund | | |
| 4,506,795 | A | 3/1985 | Herr | | |
| 4,550,844 | A | 11/1985 | Lininger | | |
| 4,560,077 | A * | 12/1985 | Dutt | B65D 41/0421 | 215/307 |
| 4,562,931 | A | 1/1986 | Brach | | |
| 4,573,601 | A | 3/1986 | Berglund | | |
| 4,938,370 | A | 7/1990 | McBride | | |
| 4,971,212 | A | 11/1990 | Kusz | | |
| 4,993,570 | A | 2/1991 | Julian | | |
| 4,997,097 | A | 3/1991 | Krautkramer | | |
| 5,050,753 | A | 9/1991 | Trump | | |
| 5,133,471 | A * | 7/1992 | Pujol Almirall | B65D 41/0471 | 215/252 |
| 5,167,335 | A | 12/1992 | McBride | | |
| 5,197,620 | A * | 3/1993 | Gregory | B65D 41/3428 | 215/307 |
| 5,205,426 | A | 4/1993 | McBride | | |
| 5,328,044 | A | 7/1994 | Rohrs | | |
| 5,356,021 | A | 10/1994 | McBride | | |
| 5,450,972 | A | 9/1995 | Zemlo | | |
| 5,501,349 | A | 3/1996 | McCandless | | |
| 5,564,582 | A | 10/1996 | Kamath | | |
| 5,588,545 | A | 12/1996 | King | | |
| 5,609,276 | A | 3/1997 | Greatbatch | | |
| 5,715,959 | A | 2/1998 | Pfefferkorn | | |
| 5,782,369 | A | 7/1998 | Tansey | | |
| 5,797,506 | A | 8/1998 | Kehmkuhl | | |
| 5,800,764 | A | 9/1998 | Smeyak | | |
| 5,860,542 | A | 1/1999 | Takamatsu | | |
| 5,950,850 | A | 9/1999 | Takamatsu | | |
| 5,975,369 | A | 11/1999 | Yurkewicz | | |
| 6,006,930 | A | 12/1999 | Dryer | | |
| 6,089,390 | A | 7/2000 | Druitt | | |
| 6,202,872 | B1 | 3/2001 | Smeyak | | |
| 6,276,543 | B1 | 8/2001 | German | | |
| 6,321,924 | B1 | 11/2001 | Yurkewicz | | |
| 6,325,225 | B1 | 12/2001 | Druitt | | |
| 6,371,317 | B1 | 4/2002 | Krueger | | |
| 6,484,896 | B2 | 11/2002 | Ma | | |
| 6,527,132 | B1 | 3/2003 | Druitt | | |
| 6,557,714 | B2 | 5/2003 | Babcock | | |
| 6,673,298 | B2 | 1/2004 | Krueger | | |
| 6,695,161 | B2 * | 2/2004 | Kano | B65D 41/0421 | 215/341 |
| 6,705,479 | B2 | 3/2004 | Druitt | | |
| 6,758,359 | B2 | 7/2004 | Yurkewicz | | |
| 6,779,672 | B2 | 8/2004 | Kano | | |
| 6,991,123 | B2 | 1/2006 | Druitt | | |
| 6,997,359 | B2 | 2/2006 | Boggs | | |
| 7,014,055 | B2 | 3/2006 | Kano | | |
| 7,055,710 | B2 * | 6/2006 | King | B65D 41/0421 | 215/344 |
| 7,066,360 | B2 | 6/2006 | Hearld | | |
| 7,344,039 | B2 | 3/2008 | Bixler | | |
| 7,451,898 | B2 | 11/2008 | Seidita | | |
| 7,503,468 | B2 | 3/2009 | Druitt | | |
| 7,607,547 | B2 | 10/2009 | Kumata | | |
| 7,637,384 | B2 | 12/2009 | Price | | |
| 7,644,843 | B1 | 1/2010 | Bush | | |
| 7,942,287 | B2 | 5/2011 | King | | |
| 7,975,864 | B2 | 7/2011 | Druitt | | |
| 8,807,360 | B2 | 8/2014 | Erspamer | | |
| 9,290,308 | B2 | 3/2016 | Bashyam | | |
| 2001/0027957 | A1 | 10/2001 | Kano | | |
| 2001/0040176 | A1 | 11/2001 | Kimble | | |
| 2002/0030031 | A1 | 3/2002 | Druitt | | |
| 2002/0066713 | A1 | 6/2002 | Ma | | |
| 2002/0074365 | A1 | 6/2002 | Young | | |
| 2002/0134747 | A1 | 9/2002 | Babcock | | |
| 2003/0116523 | A1 | 6/2003 | Druitt | | |
| 2004/0060893 | A1 | 4/2004 | Kano | | |
| 2004/0155007 | A1 | 8/2004 | Hearld | | |
| 2004/0238478 | A1 | 12/2004 | Druitt | | |
| 2005/0189312 | A1 | 9/2005 | Bixler | | |
| 2006/0163193 | A1 | 7/2006 | Smeyak | | |
| 2007/0125785 | A1 | 6/2007 | Robinson | | |
| 2007/0131641 | A1 | 6/2007 | Higgins | | |
| 2008/0023502 | A1 | 1/2008 | Knes | | |
| 2008/0087625 | A1 | 4/2008 | Kumata | | |
| 2009/0159555 | A1 | 6/2009 | Druitt | | |
| 2010/0163509 | A1 | 7/2010 | Hoffa | | |
| 2013/0256306 | A1 * | 10/2013 | Dreyer | B65D 41/0421 | 220/203.01 |
| 2014/0021157 | A1 | 1/2014 | Gren | | |
| 2015/0197380 | A1 | 7/2015 | Bashyam | | |

FOREIGN PATENT DOCUMENTS

| | | | |
|---|---|---|---|
| EP | 1679267 | A2 | 7/2006 |
| GB | 1 593 072 | A | 7/1981 |
| JP | H-10203551 | A | 8/1998 |
| WO | WO 2006/053845 | A1 | 5/2006 |
| WO | WO 2009/106509 | A1 | 9/2009 |
| WO | WO 2010/046566 | A1 | 4/2010 |

* cited by examiner

CLOSURE AND PACKAGE THAT VENTS AT HIGH PRESSURE

FIELD OF THE INVENTION

The present invention relates generally to a polymeric closure for a package. More specifically, the present invention relates to a polymeric closure or package that vents at high pressure.

BACKGROUND OF THE INVENTION

In one-piece polymeric closures, the primary or strongest seal is made by contacting with the outside (an exterior surface) and/or lower part of the outer radius of the finish of a container. Sealing in this location is highly effective at holding internal pressure and preserving the product within the container. One drawback of such a seal is that as the internal pressure increases within the package, the closure begins to dome. This doming pulls the seal geometry radially inward (toward the centerline of the finish opening), which further increases the contact pressure between the closure and these areas of the finish.

If the internal pressure builds within the package, this can lead to potentially undesirable situations. For example, if the package is contaminated and the contents of the package begin to ferment, rather than allowing a safe release of built-up gases, existing closures become stronger and allow pressure to build. When pressure builds to threshold levels, the container may rupture or release from the finish. Both are undesirable situations. Even if the package does not fail in a static state, the package may fail in a dynamic state. For example, when the package is put into a dynamic state (e.g., opening), the closure could still release from the finish due to high internal pressure, which would be undesirable.

It would be desirable to provide a closure that still provides a strong and desirable seal in a one-piece closure, while assisting in preventing or inhibiting pressure to build-up in the package that can lead to potential undesirable conditions.

SUMMARY

According to one embodiment, a closure comprises a polymeric top wall portion, a polymeric annular skirt portion, a polymeric continuous plug seal, a top sealing member and a top stop. The polymeric annular skirt portion depends from the polymeric top wall portion. The annular skirt portion includes an internal thread formation for mating engagement with an external thread formation in a finish of an associated container. The polymeric annular skirt portion includes an interior surface and an exterior surface. The polymeric continuous plug seal depends from the polymeric top wall portion. The continuous plug seal is spaced from the interior surface of the polymeric annular skirt portion. The top sealing member depends from the polymeric top wall portion. The top sealing member is located between the continuous plug seal and the annular skirt portion. The top sealing member is continuous. The top stop depends from the polymeric top wall portion. The top stop is located between the continuous plug seal and the annular skirt portion. The top sealing member extends to and contacts (a) a top surface of the finish of the container, (b) a top portion of the inner radius or inner corner of the finish of the container, (c) a top portion of the outer radius or outer corner of the finish of the container, or (d) any combination thereof when the closure and the container are in mating engagement with each other at an atmospheric internal pressure. The top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and the container are in mating engagement with each other under an internal pressure of at least about 50 psi.

According to one embodiment, a package comprises a container and a closure. The container has a finish defining an opening. The container has an external thread formation on the finish. The closure is configured for fitment to the finish of the container for closing the opening. The closure comprises a polymeric top wall portion, a polymeric annular skirt portion, a polymeric continuous plug seal, a top sealing member and a top stop. The polymeric annular skirt portion depends from the polymeric top wall portion. The annular skirt portion includes an internal thread formation for mating engagement with the external thread formation on the finish of the container. The polymeric annular skirt portion includes an interior surface and an exterior surface. The polymeric continuous plug seal depends from the polymeric top wall portion. The continuous plug seal is spaced from the interior surface of the polymeric annular skirt portion. The top sealing member depends from the polymeric top wall portion. The top sealing member is located between the continuous plug seal and the annular skirt portion. The top sealing member is continuous. The top stop depends from the polymeric top wall portion. The top stop is located between the continuous plug seal and the annular skirt portion. The top sealing member extends to and contacts (a) a top surface of the finish of the container, (b) a top portion of the inner radius or inner corner of the finish of the container, (c) a top portion of the outer radius or outer corner of the finish of the container, or (d) any combination thereof when the closure and the container are in mating engagement with each other at an atmospheric internal pressure. The top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and the container are in mating engagement with each other under an internal pressure of at least about 50 psi.

According to another embodiment, a closure comprises a polymeric top wall portion, a polymeric annular skirt portion, a polymeric continuous plug seal, a polymeric tamper-evident feature, a top sealing member and a top stop. The polymeric annular skirt portion depends from the polymeric top wall portion. The annular skirt portion includes an internal thread formation for mating engagement with an external thread formation in a finish of an associated container. The polymeric annular skirt portion includes an interior surface and an exterior surface. The polymeric continuous plug seal depends from the polymeric top wall portion. The continuous plug seal is spaced from the interior surface of the polymeric annular skirt portion. The polymeric tamper-evident feature is a band The tamper-evident feature depends from and is at least partially detachably connected to the polymeric annular skirt portion by a frangible connection. The top sealing member depends from the polymeric top wall portion. The top sealing member is located between the continuous plug seal and the annular skirt portion. The top sealing member is continuous. The top sealing member extends downwardly from the top wall portion and outwardly towards the polymeric annular skirt portion. The top stop depends from the polymeric top wall portion. The top stop is located between the continuous plug seal and the annular skirt portion. The top stop is located between the top sealing member and the polymeric annular skirt portion. The top sealing member extends to and contacts (a) a top surface of the finish of the container, (b) a top portion of the inner radius or inner corner of the finish of the container, (c) a top portion of the outer radius or outer corner of the finish of the container, or (d) any combination thereof when the closure and the container are in mating engagement with each other at an atmospheric internal pressure. The top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and the container are in mating engagement with each other under an internal pressure of at least about 60 psi.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
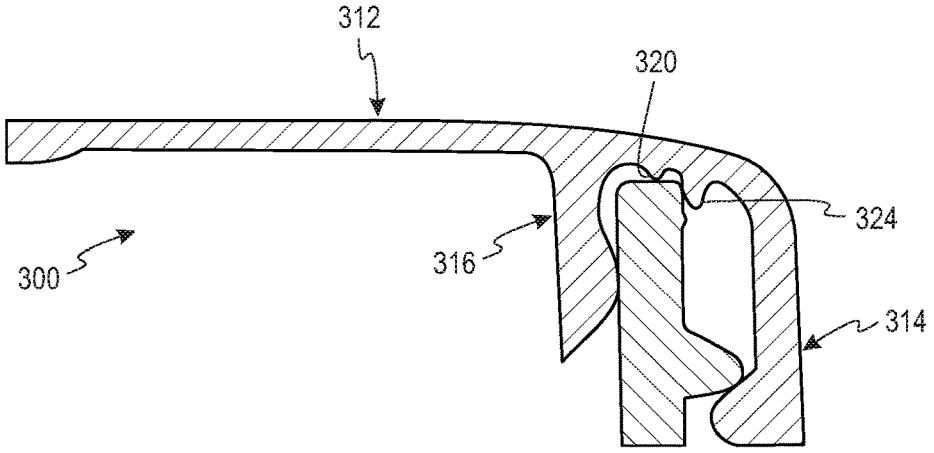
Fig. 1A PRIOR ART
FIG. 1A is a prior art partial cross-sectional view of a package under a lower internal pressure.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 2A:
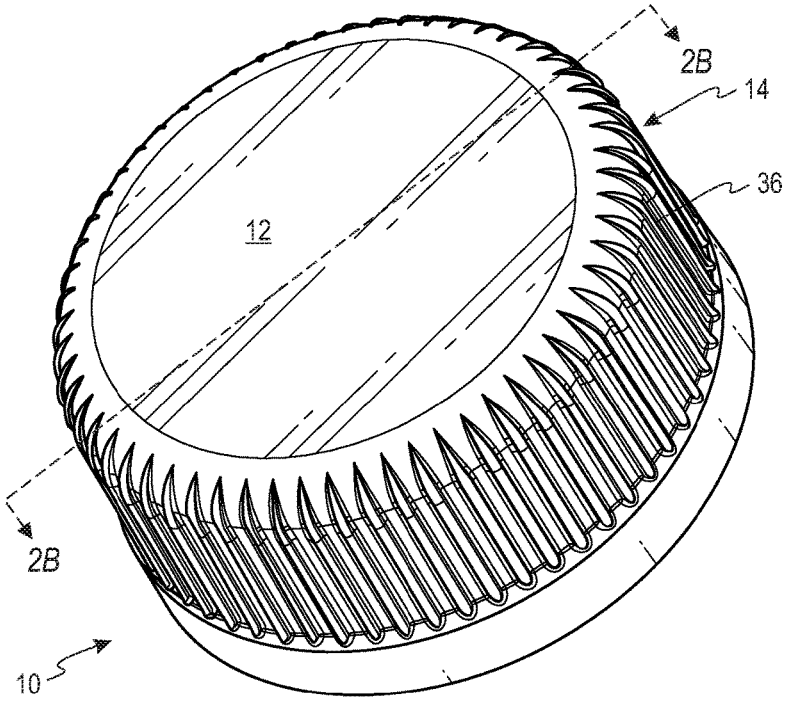
FIG. 2A is a perspective top view of a closure according to one embodiment of the present invention.
Figure 2B:
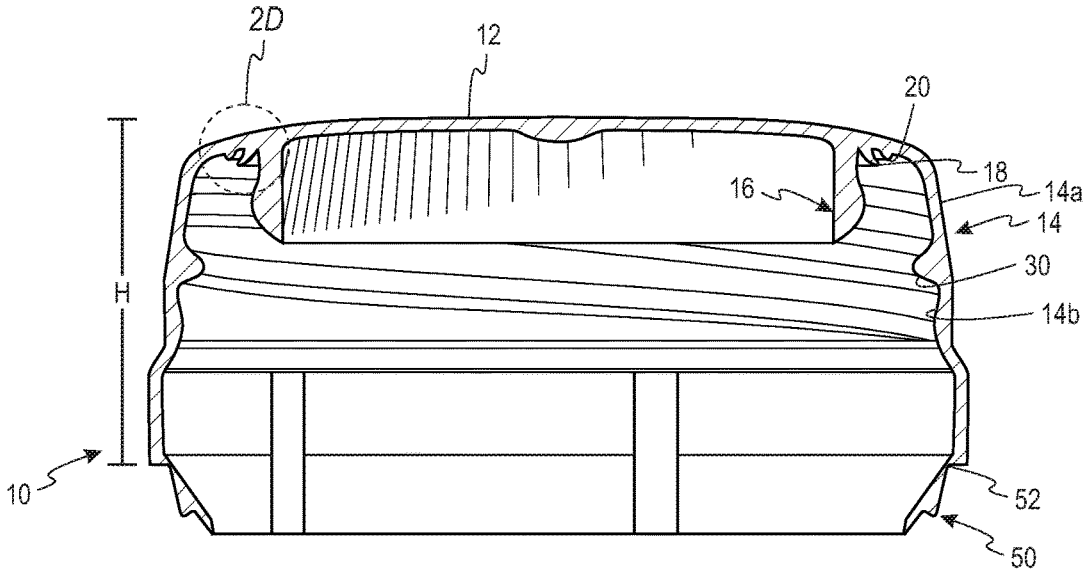
FIG. 2B is a cross-sectional view of the closure of FIG. 2A taken generally along line 2B-2B.
Figure 2C:
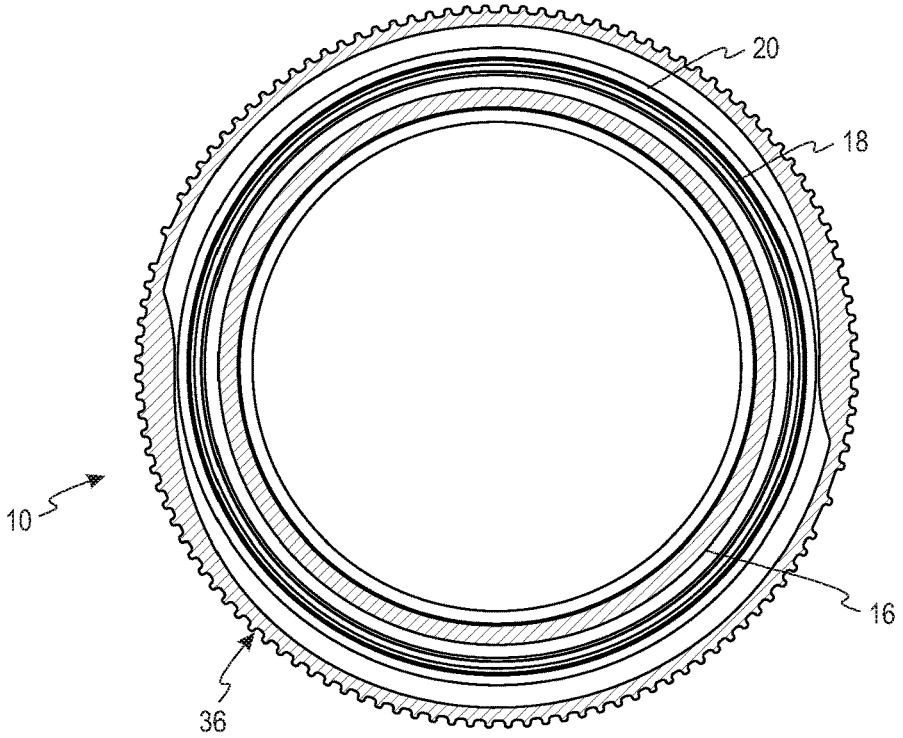
FIG. 2C is a bottom cross-sectional view of the closure of FIG. 2A.

FIGS. 2A-2C illustrate a polymeric closure 10 according to one embodiment of the present invention. The closures are configured to be placed on a container or bottle that contain product. The product is typically a liquid product, but also may be a solid product or a combination of a liquid and solid product. The polymeric closure 10 of FIGS. 2A-2C is a one-piece closure assembly and is a generally cylindrical shape.

Referring still to FIGS. 2A-2C, a polymeric closure 10 includes a polymeric top wall portion 12, a polymeric annular skirt portion 14 that depends from the polymeric top wall portion 12, a polymeric continuous plug seal 16, a top sealing member 18 and a top stop 20. The top wall portion 12 of FIGS. 1A-1C extends across the entire top of the closure without any openings in this embodiment.

The polymeric annular skirt portion 14 of FIGS. 2A-2C and 3A includes an internal thread formation 30. The polymeric annular skirt portion 14 includes an exterior surface 14*a* and an interior surface 14*b*. The internal thread formation 30 is configured for mating engagement with a corresponding external thread formation of a neck portion of a container. The internal thread formation of the closure may include continuous or discontinuous thread segments, and may include single or multiple leads or threads. Thus, it is contemplated that different thread formations may be used in the closure. One non-limiting example of an internal thread formation is a helical thread formation.

Figure 3A:
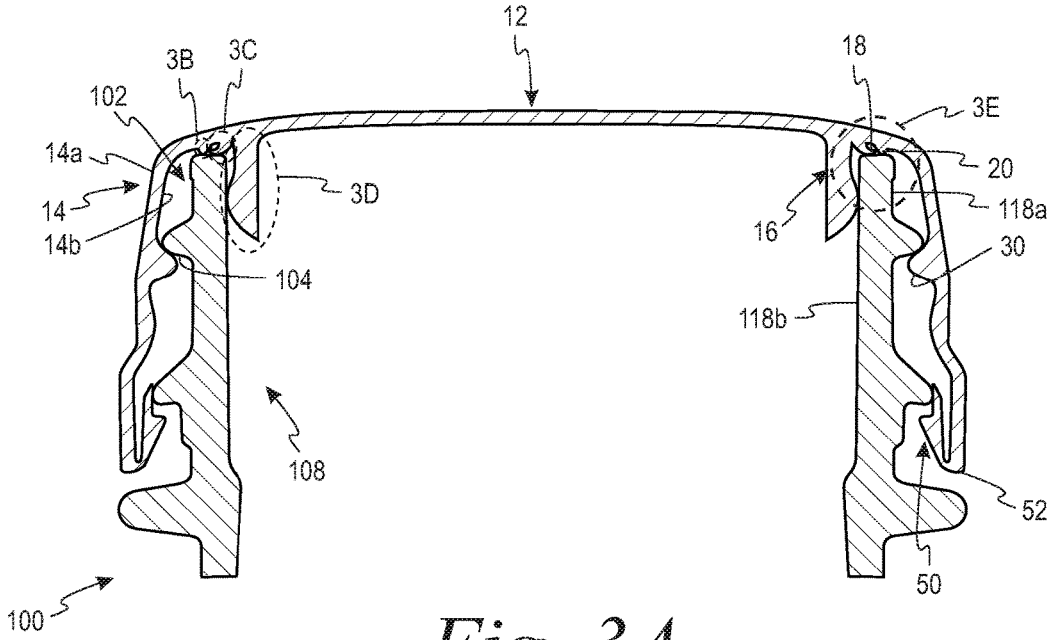
FIG. 3A is a cross-sectional view of the closure of FIG. 2B in threaded connection with a container according to one embodiment of the invention.

The polymeric continuous plug seal 16 depends from the polymeric top wall portion 12 as shown in FIGS. 2B and 3A. The continuous plug seal 16 works in conjunction with the finish of the container to form a seal as will be discussed below in conjunction with FIG. 3A. The continuous plug seal 16 is adapted to form a physical, hermetic seal with the finish container at lower internal pressures. This can include a slight vacuum when a hot-fill process is implemented. This can also include an atmospheric internal pressure (1 bar or 14.7 psi). The continuous plug seal 16 of FIG. 2B is spaced from and is not directly connected to the polymeric annular skirt portion 14. By being disconnected from the annular skirt portion 14, any impact to the exterior surface 14*a* of the polymeric annular skirt portion 14 will have less risk of being transferred to the finish of the container, which can potentially disturb the seal between the continuous plug seal 16 and the finish. Such a disturbance can cause a loss in product integrity.

Referring back to FIGS. 2B-2C, the top sealing member 18 is shown as being continuous in FIG. 2C and is in the form of a generally circular ring. The top sealing member 18 is spaced from and located between the continuous plug seal 16 and the polymeric annular skirt portion 14. Thus, the top sealing member 18 does not extend radially in such a manner to contact the polymeric annular skirt portion 14. By having the top sealing member 18 being disconnected from the annular skirt portion 14, there is a reduced risk to disturbing the seal formed by the top sealing member 18 when there is an impact to the exterior surface 14*a* of the annular skirt portion 14. This assists in reducing or eliminating a potential sealing problem that can led to a loss of product integrity.

The top sealing member 18 depends from the polymeric top wall portion 12. The top sealing member 18 extends to and contacts (a) a top surface of the finish of the container, (b) a top portion of the inner radius or inner corner of the finish of the container, (c) a top portion of the outer radius or outer corner of the finish of the container, or (d) any combination thereof when the closure and container are in mating engagement with each other under an atmospheric internal pressure (1 bar or 14.7 psi).

Figure 3B:
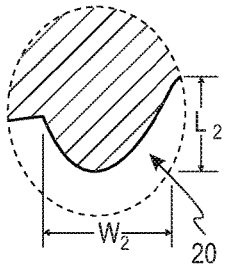
FIG. 3B is an enlarged area 3B depicted in FIG. 3A.
Figure 3C:
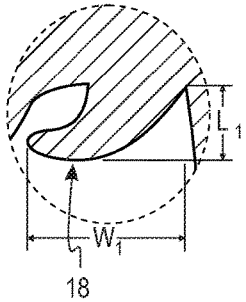
FIG. 3C is an enlarged area 3C depicted in FIG. 3A.
Figure 3D:
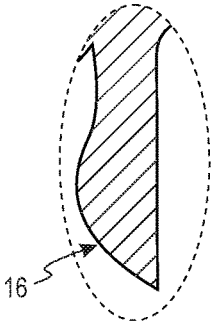
FIG. 3D is an enlarged area 3D depicted in FIG. 3A.
Figure 3E:
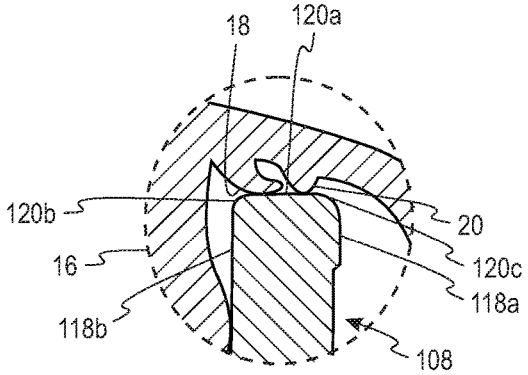
FIG. 3E is an enlarged area 3E depicted in FIG. 3A.

The top sealing member contacting a top surface of a container finish is shown in, for example, FIG. 3*e*. Specifically, FIG. 3*e* shows the top seal member 18 contacting a top surface 120*a* of the finish of a container 108. The finish of the container 108 includes an inner radius 120*b* and an outer radius 120*c*. Instead of inner radius 120*b* and outer radius 120*c* shown in FIG. 3*e*, the finish of the container may have an inner corner and an outer corner. The top surface and side surface may be generally perpendicular to each other in forming the inner and outer corners. In another embodiment, the inner and outer corners may be chamfered. It is contemplated that the top sealing member may contact the top surface of the inner radius/inner corner and/or the top surface of the outer radius/outer corner of the container finish. The top sealing member, however, does not contact an outer surface 118*a* or an inner surface 118*b* of the finish of the container at any time to form an outer side seal or inner side seal.

The top sealing member 18 may form a physical, hermetic seal with the finish of the container until a certain pressure occurs. Thus, the top sealing member 18 is strong enough to secure the contents of the package, but more importantly will not get stronger as internal pressure builds in the package. At lower internal pressures, the top sealing member 18 works especially well as a seal when the package is opened and then reclosed by a user.

The top sealing member 18 generally has a seal contact pressure with the finish of the container of greater than about 2,500 psi at internal package pressures less than 40 psi. The top sealing member 18 more typically has a seal contact pressure with the finish of the container of greater than about 3,000 psi at internal package pressures less than 25 psi. To maintain a proper seal between the top sealing member and the container, the seal contact pressure needs to be above a certain threshold, which depends on the design and materials of the closure.

The top sealing member 18 is spaced from and located above (a) a top surface of the finish of the container, (b) a top portion of the inner radius or inner corner of the finish of the container, and (c) a top portion of the outer radius or outer corner of the finish of the container when the closure and container are in mating engagement with each other under an internal pressure of at least about 50 psi in one embodiment or of at least about 60 psi according to another embodiment.

The top sealing member 18 is spaced from and located above (a) a top surface of the finish of the container, (b) a top portion of the inner radius or inner corner of the finish of the container, and (c) a top portion of the outer radius or outer corner of the finish of the container when the closure and container are in mating engagement with each other under an internal pressure of at least about 70 psi in one embodiment or of at least about 80 psi according to a further embodiment.

The top sealing member 18 is spaced from and located above (a) a top surface of the finish of the container, (b) a top portion of the inner radius or inner corner of the finish of the container, and (c) a top portion of the outer radius or outer corner of the finish of the container when the closure and container are in mating engagement with each other under an internal pressure of at least about 90 psi in another embodiment.

Figure 4A:
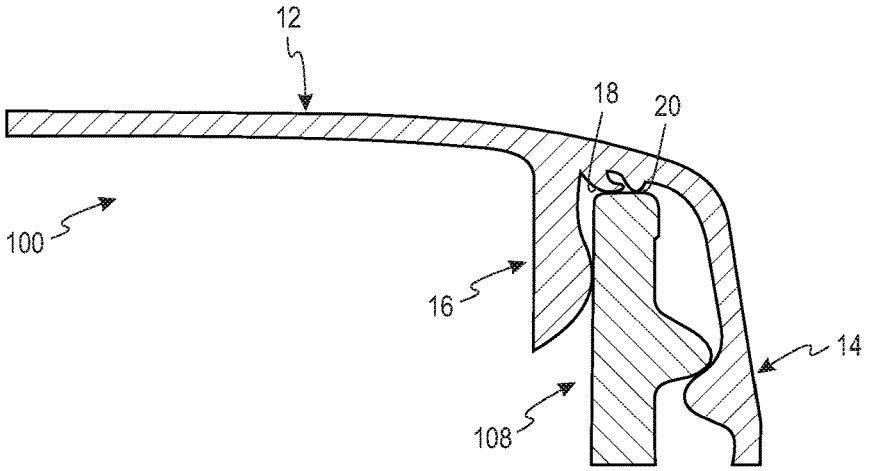
FIG. 4A is a partial cross-sectional view of a package according to FIG. 3A under an atmospheric internal pressure.
Figure 4B:
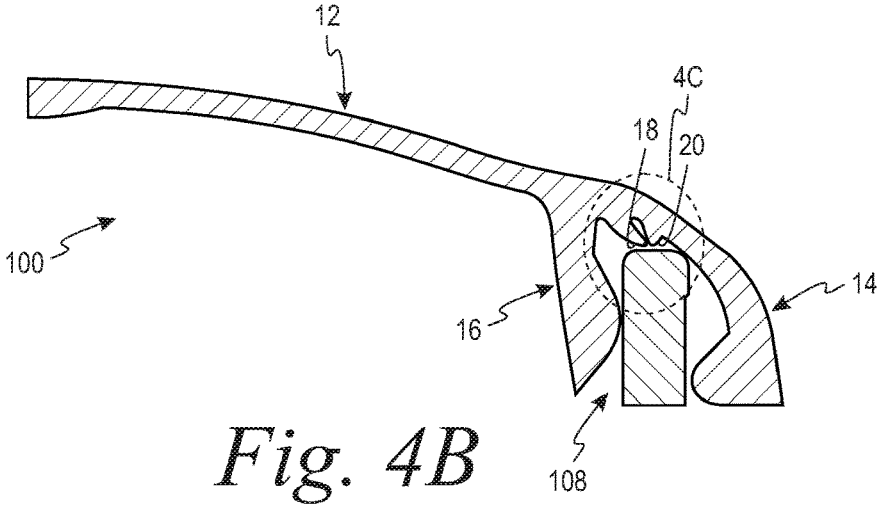
FIG. 4B a partial cross-sectional view of a package according to FIG. 3A under a higher internal pressure.

FIG. 4*a* depicts a partial cross-sectional view of a package 100 under a lower internal pressure such as a slight vacuum or atmospheric internal pressure, while FIG. 4B depicts a partial cross-sectional view of the package 100 under a higher internal pressure such as 70 psi.

Figure 4C:
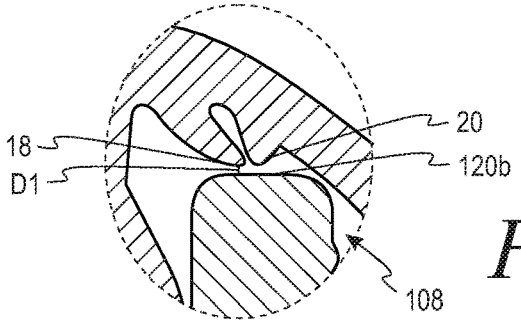
FIG. 4C is an enlarged area 4C depicted in FIG. 4B.

The distance between the top sealing member 18 and the top surface 120*a* of the finish of the container is shown in FIG. 4C as distance D1. The distance D1 needs to be a sufficient distance such that the higher internal pressures do not build-up in the package. Distance D1 is generally from about 0.0005 to about 0.001 inches at 50 psi. Distance D1 is generally from about 0.001 to about 0.0015 inches at 70 psi.

The top sealing member 18 is shown in FIG. 2B as extending downwardly from the polymeric top wall portion 12 and outwardly towards the polymeric annular skirt portion 14. It is contemplated that the top sealing member may extend downwardly from the polymeric top wall portion and inwardly away towards the polymeric annular skirt portion in an undeformed state (i.e., when the top sealing member is not contacting the finish of the container under pressure). In this embodiment, the top sealing member will typically hold the pressure for longer than a top sealing member that extends downwardly and outwardly. It is also contemplated that the top sealing member may extend downwardly in a generally perpendicular manner from the polymeric top wall portion 12. These designs can be tailored to specific applications with certain desired release pressures.

Figure 2D:
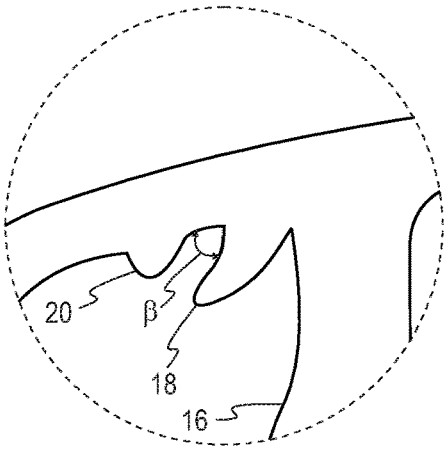
FIG. 2D is an enlarged area 2D depicted in FIG. 2B.

In one embodiment, the top sealing member extends downwardly from the polymeric top wall portion 12 and outwardly at an angle β of from about 40 to about 75 degrees when not contacting the finish of the container as shown in FIG. 2D, which is an undeformed state. More specifically, the top sealing member extends downwardly from the polymeric top wall portion 12 and outwardly at an angle β of from about 50 to about 60 degrees when not contacting the finish of the container. In a deformed state (i.e., contacting the finish of the container), the angle β is generally reduced to about 15 to about 30 degrees.

The top sealing member 18 is advantageous because as pressure builds inside the package, the continuous plug seal 16 will not seal with the container. At such pressures, the top sealing member 18 will initially seal with the container at (a) a top surface of the finish of the container, (b) a top portion of the inner radius or inner corner of the finish of the container, (c) a top portion of the outer radius or outer corner of the finish of the container, or (d) any combination thereof when the closure and the container are in mating engagement with each other. As the internal pressure increases, doming will exceed the ability of the top sealing member 18 to stay in contact with (a) a top surface of the finish of the container, (b) a top portion of the inner radius or inner corner of the finish of the container, and (c) a top portion of the outer radius or outer corner of the finish of the container. At this point in time, the top sealing member 18 will be spaced from and located above the finish of the container and will no longer form a seal.

Thus, the top sealing member 18 is strong enough to secure the contents of the package, but more importantly will generally not get stronger as internal pressure builds in the package. Once a certain internal pressure of the package is met, the top sealing member 18 loses contact and vents pressure, which creates a safe product experience to a user.

The flexibility of the top sealing member 18 allows it to work over a range of application angles and desirably allows the top sealing member 18 to initial stay in contact with the finish of the container as doming initially occurs.

The thickness W1 of the top sealing member 18 of FIG. 3C in its undeformed state is generally from about 20 to about 60 mils and, more specifically, from about 30 to about 50 mils. The length L1 of the top sealing member 18 of FIG. 3C in its undeformed state is generally from about 15 to about 45 mils and, more specifically, from about 20 to about 35 mils.

The top stop 20 assists in providing a positive stop when the finish of the container and the closure are being threaded with each other. Thus, the top stop assists in positioning the finish of the container when the closure is being threaded onto the finish. By properly positioning the finish of the container, this assists in avoiding a high removal torque and other potential capping defects. Thus, the top stop assists in obtaining desirable removal torques. The top stop 20 also assists in preventing or inhibiting the top sealing member 18 from being deformed. By inhibiting deformation, the top sealing member 18 can recover to its original shape more quickly, which will lead to venting more quickly when higher internal pressures occur. The top stop 20 is typically continuous as shown in FIG. 2C. It is contemplated that the top stop may be discontinuous in another embodiment.

The thickness W2 of the top stop 20 of FIG. 3B is generally from about 15 to about 60 mils and, more specifically, from about 25 to about 50 mils. The length L2 of the top stop 20 of FIG. 3B is generally from about 10 to about 30 mils and, more specifically, from about 10 to about 25 mils.

The closure 10 as shown in FIG. 2A includes a plurality of knurls 36 formed on the annular skirt portion 14. The plurality of knurls 36 assists the user in gripping the closure during the opening and closing of the closure from the container. The plurality of knurls 36 also provides additional strength and support to the closure itself. It is contemplated that the number and shape of the knurls, if used, may be different than depicted in FIG. 2A.

The closure of the present invention in one embodiment generally has an overall height H as shown in FIG. 2B of from about 0.4 to about 1 inch. The overall height H of the closure is typically from about 0.4 to about 0.6 inch and, more specifically, from about 0.5 inch to about 0.55 inch.

The closure may also include a polymeric tamper-evident feature. For example, the closure 10 includes a polymeric tamper-evident band 50 (FIGS. 2B and 3A) located at the bottom thereof (i.e., an end opposite of the polymeric top wall portion 12). The tamper-evident band 50 depends from and is at least partially detachably connected to the polymeric annular skirt portion 14 by a frangible connection 52. The tamper-evident band 50 works in conjunction with the container to indicate to a user that the contents of the container may have been accessed. More specifically, the tamper-evident band 50 is designed to separate from the polymeric annular skirt portion 14 if a user starts to open the package and gain access to the container.

The polymeric tamper-evident band may be formed by molded-in-bridges in one embodiment. The molded-in-bridges are typically formed using a feature in the mold. In another embodiment, the polymeric tamper-evident band may be formed using scoring or scored lines, notches, leaders, or other lines of weaknesses.

The tamper-evident band 50 is in a reversed orientation in FIG. 2B. This is a common orientation when the closure is removed from a mold and allows the closure to be ejected more easily from the closure-forming tooling. The tamper-evident band is later folded from the reversed orientation into a functional orientation, which is shown and discussed below with respect to FIG. 3A.

The closure 10 including the top wall portion 12, the annular skirt portion 14, the continuous plug seal 16, the top sealing member 18 and the top stop 20 are made of polymeric material. The closure 10 typically comprises high density polyethylene (HDPE), polypropylene (PP), or blends thereof. It is contemplated that the closure may be made of other polymeric materials. The tamper-evident band 50, if present, is typically made of the same materials as the rest of the closure.

The closures are typically formed by processes such as injection or compression molding. It is contemplated that other processes may be used in forming the closures.

The closures of the present invention, including closure 10, may be used with the container 108 to form the package 100 of FIG. 3A. A portion of the container 108 is shown in FIG. 3A and includes the neck portion or finish 102 that defines an opening. The neck portion 102 of the container 108 includes an external thread formation 104. The external thread formation 104 of the container 108 engages with the corresponding internal thread formation 30 of the closure 10 to seal the package 100. The external thread formation of the container may include continuous or discontinuous thread segments, and may include single or multiple threads. Thus, it is contemplated that different threads formations may be used in the container. One non-limiting example of an external thread formation of the container is a helical thread formation.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric materials. It is also contemplated that the container may be formed of glass. The container 108 may have an encapsulated oxygen-barrier layer or oxygen barrier material incorporated therein.

To open the container 108 and gain access to the product therein, the closure 10 is unthreaded by turning the closure 10 with respect to the container 108. The tamper-evident band 50 is in its functional orientation in FIG. 3A. The container surface naturally separates from the closure as the closure is unthreaded. After the closure has been unthreaded, the closure 10 is then removed from the container so that the user can gain access to the container. During this process, the tamper-evident band 50 is separated from the remainder of the closure 10. The tamper-evident band 50 is held in place and allows the frangible connection 52 to separate the tamper-evident band from the remainder of the closure. The tamper-evident band 50 desirably remains with the container, but it is contemplated that the tamper-evident band may be removed in a separate step from the container.

The polymeric closures of the present invention are desirable in both low-temperature and high-temperature applications. The polymeric closures of the present invention may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures formed by the processes of the present invention.

The polymeric closures of the present invention may be exposed to high-temperature applications such as hot-fill and pasteurizations. A hot fill application is generally performed at temperatures around 185° F., while a hot-fill with pasteurization is generally performed at temperatures around 205° F. It is contemplated that the polymeric closures of the present invention can be used in other high-temperature applications.

EXAMPLES

Inventive and Comparative closures were made and tested. Inventive Closure 1 was substantially similar to closure 10 shown in FIGS. 2A-2C. Inventive Closure 1 was a 33 mm one-piece configuration made of high density polyethylene (HDPE).

Figure 1B:
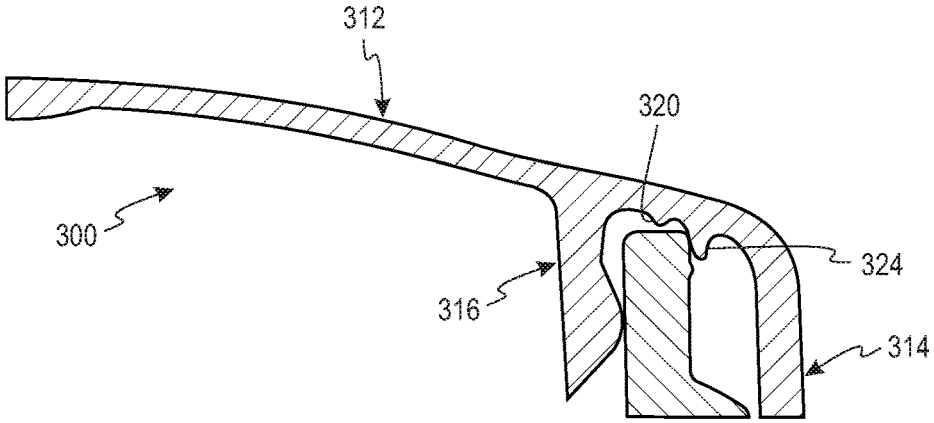
Fig. 1B PRIOR ART
FIG. 1B is a prior art partial cross-sectional view of a package under a higher internal pressure.

Comparative Closure 1 is shown in prior art FIGS. 1A, 1B as closure 300. Comparative Closure 1 was a 33 mm one-piece configuration made of high density polyethylene (HDPE). Closure 300 of FIGS. 1A, 1B includes a polymeric top wall portion 312, a polymeric annular skirt portion 314 that depends from the polymeric top wall portion 312, a polymeric continuous plug seal 316, a top stop 320 and a side sealing member 324.

A total of 12 samples of each configuration (Inventive Closure 1 and Comparative Closure 1) was tested. Each of the samples of Inventive Closure 1 and Comparative Closure 1 was tested in combination with a container or bottle. The containers were identical and made of PET with about 32 fluid ounces of water. The containers had a 33 mm, double lead, hot-fill finish. Each of the closures was threaded onto the finish of the respective containers into a closed position. The packages were conditioned at ambient temperature for roughly 24 hours. Then, the finish and closure were cut away from the remainder of the package. The cutaway finish and closure were placed in a submerged fixture/test apparatus under different pressures. Specifically, 12 samples of each closure were tested under two pressure conditions −1.5 bar and 6.9 bar (1 bar equals 14.5 psi) after the respective closures were threaded onto the containers in a closed position. The testing conditions and the results are shown in the Table 1 below.

TABLE 1

| Sample | Inventive Closure 1 | | Comparative Closure 1 | |
|---|---|---|---|---|
| No. | 1.5 bar | 6.9 bar | 1.5 bar | 6.9 bar |
| 1 | No Leak | Leak @ 3.8 | No Leak | No Leak |
| 2 | No Leak | Leak @ 4.1 | No Leak | No Leak |
| 3 | No Leak | Leak @ 3.1 | No Leak | No Leak |
| 4 | No Leak | Leak @ 3.4 | No Leak | No Leak |
| 5 | No Leak | Leak @ 4.5 | No Leak | No Leak |
| 6 | No Leak | Leak @ 3.4 | No Leak | No Leak |
| 7 | No Leak | Leak @ 3.8 | No Leak | No Leak |
| 8 | No Leak | Leak @ 3.8 | No Leak | No Leak |
| 9 | No Leak | Leak @ 3.4 | No Leak | No Leak |
| 10 | No Leak | Leak @ 3.8 | No Leak | No Leak |
| 11 | No Leak | Leak @ 4.1 | No Leak | No Leak |
| 12 | No Leak | Leak @ 3.8 | No Leak | No Leak |

As shown in Table 1 above, both Inventive Closure 1 and Comparative Closure 1 did not leak under 1.5 bar (22 psi) of internal pressure in the package. When the internal pressure of the package was increased to 6.9 bar (100 psi), Inventive Closure 1 leaked in every test. The leaking in the samples of Inventive Closure 1 began at varying pressures from 3.1 to 4.5 bar (45 psi to 65 psi) as shown in Table 1. The samples of Comparative Closure 1 did not leak as the internal pressure of the package was increased to 6.9 bar (100 psi).

What is claimed is:

1. A closure comprising:

a polymeric top wall portion;

a polymeric annular skirt portion depending from the polymeric top wall portion, the annular skirt portion including an internal thread formation for mating engagement with an external thread formation in a finish of an associated container, the polymeric annular skirt portion including an interior surface and an exterior surface;

a polymeric continuous plug seal depending from the polymeric top wall portion, the continuous plug seal being spaced from the interior surface of the polymeric annular skirt portion;

a top sealing member depending from the polymeric top wall portion, the top sealing member being located between the continuous plug seal and the annular skirt portion, the top sealing member being continuous, the top sealing member extending downwardly from the top wall portion and outwardly towards the polymeric annular skirt portion; and a top stop depending from the polymeric top wall portion, the top stop being located between the continuous plug seal and the annular skirt portion, wherein the top sealing member extends to and contacts (a) a top surface of the finish of the container, (b) a top portion of the inner radius or inner corner of the finish of the container, (c) a top portion of the outer radius or outer corner of the finish of the container, or (d) any combination thereof when the closure and the container are in mating engagement with each other without unthreading of the closure and container at an atmospheric internal pressure, wherein the top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and the container are in mating engagement with each other without unthreading of the closure and container under an internal pressure of 50 psi.

2. The closure of claim 1, wherein the closure further includes a polymeric tamper-evident feature.

3. The closure of claim 2, wherein the polymeric tamper-evident feature is a band, the tamper-evident feature depending from and is at least partially detachably connected to the polymeric annular skirt portion by a frangible connection.

4. The closure of claim 1, wherein the internal thread formation of the closure includes at least one helical thread element.

5. The closure of claim 1, wherein the shape of the closure is generally cylindrical.

6. The closure of claim 1, wherein the closure is a one-piece closure.

7. The closure of claim 1, wherein the top sealing member and the top stop extends and contacts a top surface of the finish of the container when the closure and container are in mating engagement with each other under an atmospheric internal pressure.

8. The closure of claim 1, wherein the top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and container are in mating engagement with each other under an internal pressure of 60 psi.

9. The closure of claim 1, wherein the top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and container are in mating engagement with each other under an internal pressure of at least 70 psi.

10. The closure of claim 1, wherein the distance between the top sealing member and the finish of the container is from about 0.001 to about 0.015 inches at 70 psi.

11. The closure of claim 1, wherein the top sealing member is located between the continuous plug and the top stop.

12. The closure of claim 1, wherein the distance between the top sealing member and the finish of the container is from about 0.0005 to about 0.001 inches at 50 psi.

13. A package comprising:

a container having a finish defining an opening, the container having an external thread formation on the finish; and a closure configured for fitment to the finish of the container for closing the opening, the closure comprises a polymeric top wall portion;

a polymeric annular skirt portion depending from the polymeric top wall portion, the annular skirt portion including an internal thread formation for mating engagement with the external thread formation on the finish of the container, the polymeric annular skirt portion including an interior surface and an exterior surface;

a polymeric continuous plug seal depending from the polymeric top wall portion, the continuous plug seal being spaced from the interior surface of the polymeric annular skirt portion;

a top sealing member depending from the polymeric top wall portion, the top sealing member being located between the continuous plug seal and the annular skirt portion, the top sealing member being continuous, the top sealing member extending downwardly from the top wall portion and outwardly towards the polymeric annular skirt portion; and a top stop depending from the polymeric top wall portion, the top stop being located between the continuous plug seal and the annular skirt portion, wherein the top sealing member extends to and contacts (a) a top surface of the finish of the container, (b) a top portion of the inner radius or inner corner of the finish of the container, (c) a top portion of the outer radius or outer corner of the finish of the container, or (d) any combination thereof when the closure and the container are in mating engagement with each other without unthreading of the closure and container at an atmospheric internal pressure, wherein the top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and the container are in mating engagement with each other without unthreading of the closure and container under an internal pressure of 50 psi.

14. The package of claim 13, wherein the closure further includes a polymeric tamper-evident feature.

15. The package of claim 13, wherein the closure is a one-piece closure.

16. The package of claim 13, wherein the top sealing member and the top stop extends and contacts a top surface of the finish of the container when the closure and container are in mating engagement with each other under an atmospheric internal pressure.

17. The package of claim 13, wherein the top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and container are in mating engagement with each other under an internal pressure of 60 psi.

18. The package of claim 13, wherein the top sealing member is located between the continuous plug and the top stop.

19. The package of claim 13, wherein the distance between the top sealing member and the finish of the container is from about 0.0005 to about 0.001 inches at 50 psi.

20. The package of claim 13, wherein the top sealing member has a seal contact pressure with the finish of the container of greater than about 2,500 psi at internal package pressures less than 40 psi.

21. The package of claim 13, wherein the top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and container are in mating engagement with each other under an internal pressure of at least 70 psi.

22. A closure comprising:

a polymeric top wall portion;

a polymeric annular skirt portion depending from the polymeric top wall portion, the annular skirt portion including an internal thread formation for mating engagement with an external thread formation in a finish of an associated container, the polymeric annular skirt portion including an interior surface and an exterior surface;

a polymeric continuous plug seal depending from the polymeric top wall portion, the continuous plug seal being spaced from the interior surface of the polymeric annular skirt portion;

a polymeric tamper-evident feature being a band, the tamper-evident feature depending from and is at least partially detachably connected to the polymeric annular skirt portion by a frangible connection, a top sealing member depending from the polymeric top wall portion, the top sealing member being located between the continuous plug seal and the annular skirt portion, the top sealing member being continuous, the top sealing member extending downwardly from the top wall portion and outwardly towards the polymeric annular skirt portion; and a top stop depending from the polymeric top wall portion, the top stop being located between the continuous plug seal and the annular skirt portion, the top stop being located between the top sealing member and the polymeric annular skirt portion, wherein the top sealing member extends to and contacts (a) a top surface of the finish of the container, (b) a top portion of the inner radius or inner corner of the finish of the container, (c) a top portion of the outer radius or outer corner of the finish of the container, or (d) any combination thereof when the closure and the container are in mating engagement with each other without unthreading of the closure and container at an atmospheric internal pressure, wherein the top sealing member and the top stop are adapted to be spaced from and located above (a) the top surface of the finish of the container, (b) the top portion of the inner radius and inner corner of the finish of the container, and (c) the top portion of the outer radius and outer corner of the finish of the container when the closure and the container are in mating engagement with each other without unthreading of the closure and container under an internal pressure of 60 psi.

* * * * *